US012018685B2

(12) United States Patent
Bonnefoi

(10) Patent No.: US 12,018,685 B2
(45) **Date of Patent: *Jun. 25, 2024**

(54) SCROLL COMPRESSOR PROVIDED WITH AN HYDROSTATIC LOWER BEARING ARRANGEMENT

(71) Applicant: Danfoss Commercial Compressors, Trevoux (FR)

(72) Inventor: Patrice Bonnefoi, Nordborg (DK)

(73) Assignee: DANFOSS COMMERCIAL COMPRESSORS, Trevoux (FR)

( * ) Notice: Subject to any disclaimer, the term of this patent is extended or adjusted under 35 U.S.C. 154(b) by 36 days.

This patent is subject to a terminal disclaimer.

(21) Appl. No.: 17/690,533

(22) Filed: Mar. 9, 2022

(65) Prior Publication Data

US 2022/0290666 A1 Sep. 15, 2022

(30) Foreign Application Priority Data

Mar. 10, 2021 (FR) ..... 2102351

(51) Int. Cl.
*F04C 18/02* (2006.01)
*F04C 23/00* (2006.01)
(Continued)

(52) U.S. Cl.
CPC ..... *F04C 18/0215* (2013.01); *F04C 23/008* (2013.01); *F04C 29/00* (2013.01);
(Continued)

(58) Field of Classification Search
CPC .... F04C 18/0215; F04C 23/008; F04C 29/00; F04C 29/02; F04C 29/025; F04C 2240/30;
(Continued)

(56) References Cited

U.S. PATENT DOCUMENTS 4,332,535 A 6/1982 Terauchi et al.
4,565,503 A 1/1986 Wise
(Continued)

FOREIGN PATENT DOCUMENTS

CN 101476561 A 7/2009
CN 110894833 A 3/2020
(Continued)

OTHER PUBLICATIONS

First Examination Report for Indian Patent Application No. 202214005671, dated Sep. 23, 2022.
(Continued)

*Primary Examiner* — Mary Davis
(74) *Attorney, Agent, or Firm* — McCormick, Paulding & Huber PLLC

(57) ABSTRACT

The scroll compressor includes a compression unit; a drive shaft which is vertically orientated; a lower bearing arrangement (28) configured to rotatably support the drive shaft; and an oil pump (29) arranged at a lower end of the drive shaft and configured to deliver oil to the compression unit and to the lower bearing arrangement (28). The lower bearing arrangement (28) comprises a radial bearing housing (34) including an inner radial bearing surface (37) surrounding the lower end portion of the drive shaft; upper and lower axial thrust bearings (43, 44) configured to limit an axial movement of the drive shaft; and a pressurized oil chamber (51) fluidly connected to the oil pump (29), the pressurized oil chamber (51) being at least partially delimited by the outer surface of the lower end portion of the drive shaft, the inner radial bearing surface (37) and the upper and lower axial thrust bearings (43, 44).

18 Claims, 4 Drawing Sheets

(51) Int. Cl.
*F04C 29/00* (2006.01)
*F04C 29/02* (2006.01)

(52) U.S. Cl.
CPC ..... *F04C 29/02* (2013.01); *F04C 29/025* (2013.01); *F04C 2240/30* (2013.01); *F04C 2240/40* (2013.01); *F04C 2240/50* (2013.01); *F04C 2240/60* (2013.01); *F04C 2240/80* (2013.01)

(58) Field of Classification Search
CPC ..... F04C 2240/40; F04C 2240/50; F04C 2240/60; F04C 2240/80
See application file for complete search history.

(56) References Cited

U.S. PATENT DOCUMENTS

| | | | | |
|---|---|---|---|---|
| 4,886,435 | A | 12/1989 | Sawai et al. | |
| 5,533,875 | A | 7/1996 | Crum et al. | |
| 6,000,917 | A | 12/1999 | Smerud et al. | |
| 6,171,090 | B1 | 1/2001 | Hurley | |
| 6,264,446 | B1 | 7/2001 | Rajendran et al. | |
| 7,351,045 | B2 | 4/2008 | Sugimoto et al. | |
| 8,992,191 | B2 * | 3/2015 | Ahn | F04C 29/025 418/94 |
| 2007/0065307 | A1 | 3/2007 | Sugimoto et al. | |
| 2008/0069714 | A1 | 3/2008 | Bonifas | |
| 2012/0134859 | A1 | 5/2012 | Duppert | |
| 2013/0078131 | A1 | 3/2013 | Ahn et al. | |
| 2015/0030487 | A1 * | 1/2015 | Toyama | F04C 29/02 418/55.1 |
| 2015/0044019 | A1 | 2/2015 | Wu et al. | |
| 2022/0290671 | A1 * | 9/2022 | Bonnefoi | F04C 29/025 |

FOREIGN PATENT DOCUMENTS

| | | | |
|---|---|---|---|
| CN | 111102160 | A | 5/2020 |
| CN | 212272547 | U | 1/2021 |
| EP | 1413758 | A2 | 4/2004 |
| FR | 3031549 | A1 | 7/2016 |
| JP | 52069614 | U | 5/1977 |
| JP | 56013570 | U | 2/1981 |
| JP | 57020585 | U | 2/1982 |
| JP | 59003182 | A | 1/1984 |
| JP | 58044488 | U | 3/1984 |
| JP | 60237182 | A | 11/1985 |
| JP | H05-65884 | A | 3/1993 |
| JP | H09-32760 | A | 2/1997 |
| JP | 2002-21731 | A | 1/2002 |
| JP | 2002310076 | A | 10/2002 |
| JP | 2003172277 | A | 6/2003 |
| JP | 2014118932 | A | 6/2014 |
| JP | 2017172484 | A | 9/2017 |
| JP | 2018141427 | A | 9/2018 |

OTHER PUBLICATIONS

English Translation of Chen et al. (CN 111102160 A), Published May 5, 2020. (Year: 2020).
First Examination Report for Indian Patent Application No. 202214005672, dated Sep. 21, 2022.
First Office Action for Chinese Patent Application No. 202210154358.4, dated Oct. 24, 2023, and its English translation.
Notice for Indian Patent Application No. 202214005671, dated Feb. 5, 2024.

* cited by examiner

SCROLL COMPRESSOR PROVIDED WITH AN HYDROSTATIC LOWER BEARING ARRANGEMENT

CROSS-REFERENCE TO RELATED APPLICATION

This application claims foreign priority benefits under 35 U.S.C. § 119 to French Patent Application No. 2102351 filed on Mar. 10, 2021, the content of which is hereby incorporated by reference in its entirety.

TECHNICAL FIELD

The present invention relates to a scroll compressor, and in particular to a scroll refrigeration compressor.

BACKGROUND

As known, a scroll compressor comprises:

- a hermetic outer shell provided with a suction inlet intended to receive low pressure refrigerant gas from a component of a refrigerant cycle and a discharge outlet intended to deliver compressed refrigerant gas at high pressure to another component of the refrigerant cycle,
- a compression unit including at least a first scroll element and a second scroll element, the second scroll element being configured to perform an orbiting movement relative to the first scroll element during operation of the scroll compressor,
- a drive shaft which is vertically orientated and which is configured to cooperate with the second scroll element,
- an electric motor comprising a stator connected to the hermetic outer shell and a rotor secured to the drive shaft, the electric motor being configured to drive in rotation the drive shaft about a rotation axis,
- an upper bearing arrangement and a lower bearing arrangement configured to rotatably support the drive shaft within the hermetic outer shell, the upper and lower bearing arrangements being connected to the hermetic outer shell, and
- an oil pump arranged at a lower end of the drive shaft and immersed in an oil sump arranged in a bottom section of the hermetic outer shell, the oil pump being configured to deliver, during operation of the scroll compressor, oil to the compression unit and to the upper and lower bearing arrangements.

The lower bearing arrangement comprises a radial journal bearing configured to rotatably support a lower end portion of the drive shaft, and a lower axial thrust bearing configured to limit an axial movement of the drive shaft towards the bottom section of the hermetic outer shell. The lower bearing arrangement particularly includes a radial bearing housing including an inner radial bearing surface surrounding an outer surface of the lower end portion of the drive shaft and forming the radial journal bearing. The lower axial thrust bearing is advantageously formed by a lower axial end surface of the drive shaft and by an internal bottom surface of the radial bearing housing.

During operation of the scroll compressor, the oil pump supplies the inner radial bearing surface and the lower axial thrust bearing with lubricant oil from the oil sump and the lubricant oil leaves the lower bearing arrangement at an upper axial end of the radial bearing housing.

When such a scroll compressor operates at high rotational speed, the lubrication of the radial journal bearing and the lower axial thrust bearing may be insufficient, leading particularly to high friction losses at the lower axial thrust bearing due to the gravitational force, derived from the mass of the drive shaft, that occurs at the internal bottom surface of the radial bearing housing. Such high friction losses at the lower axial thrust bearing harm the compressor efficiency and also cause wear of the thrust bearing surfaces, which reduces the lifetime of the scroll compressor.

SUMMARY

It is an object of the present invention to provide an improved scroll compressor which can overcome the drawbacks encountered in conventional scroll compressors.

Particularly, an object of the present invention is to provide a scroll compressor which has improved efficiency and lifetime compared to the conventional scroll compressors.

According to the invention such a scroll compressor includes:

- a hermetic outer shell provided with a suction inlet configured to supply the scroll compressor with refrigerant gas to be compressed and a discharge outlet configured to discharge compressed refrigerant gas,
- a compression unit including at least a first scroll element and a second scroll element, the second scroll element being configured to perform an orbiting movement relative to the first scroll element during operation of the scroll compressor,
- a drive shaft which is vertically orientated and which is configured to cooperate with the second scroll element,
- an electric motor comprising a stator connected to the hermetic outer shell and a rotor secured to the drive shaft, the electric motor being configured to drive in rotation the drive shaft about a rotation axis,
- an upper bearing arrangement and a lower bearing arrangement configured to rotatably support the drive shaft within the hermetic outer shell, and
- an oil pump arranged at a lower end of the drive shaft and immersed in an oil sump arranged in a bottom section of the hermetic outer shell, the oil pump being configured to deliver, during operation of the scroll compressor, oil to the compression unit and to the upper and lower bearing arrangements, wherein the lower bearing arrangement comprises:

- a radial bearing housing configured to rotatably support a lower end portion of the drive shaft, the radial bearing housing including an inner radial bearing surface surrounding an outer surface of the lower end portion of the drive shaft,
- upper and lower axial thrust bearings configured to limit an axial movement of the drive shaft during operation, and
- a pressurized oil chamber which is fluidly connected to the oil pump, the pressurized oil chamber being at least partially delimited by the outer surface of the lower end portion of the drive shaft, the inner radial bearing surface and the upper and lower axial thrust bearings.

Such a configuration of the lower bearing arrangement, and particularly the provision of the pressurized oil chamber, leads to significant hydrodynamic pressure in the pressurized oil chamber when the scroll compressor operates at high rotational speed. Such a significant hydrodynamic pressure generate hydrostatic forces at the upper and lower axial thrust bearings which may be in the same magnitude as the gravitational force derived from the mass of the drive shaft. This improves the lubrication of the upper and lower axial thrust bearings and the compressor efficiency due to reduced frictional losses at the upper and lower axial thrust bearings. Further, wear of the thrust bearing surfaces of the upper and lower axial thrust bearings is reduced, which improves the lifetime of the scroll compressor.

The scroll compressor may also include one or more of the following features, taken alone or in combination.

According to an embodiment of the invention, the lower bearing arrangement is a hydrostatic lower bearing arrangement.

According to an embodiment of the invention, the upper and lower bearing arrangements being connected to the hermetic outer shell.

According to an embodiment of the invention, the oil pump is configured to deliver, during operation of the scroll compressor, oil to the compression unit and to the upper bearing arrangement through an oil supplying channel formed within the drive shaft and extending over at least a part of the length of the drive shaft.

According to an embodiment of the invention, the radial bearing housing surrounds the lower end portion of the drive shaft and is arranged coaxially with the drive shaft.

According to an embodiment of the invention, the radial bearing housing is formed by a radial bearing sleeve.

According to an embodiment of the invention, the inner radial bearing surface is cylindrical.

According to an embodiment of the invention, the upper axial thrust bearing is located above the inner radial bearing surface and the lower axial thrust bearing is located below the inner radial bearing surface.

According to an embodiment of the invention, the pressurized oil chamber is delimited in an axial direction respectively by the upper and lower axial thrust bearings.

According to an embodiment of the invention, the pressurized oil chamber is substantially closed by the upper and lower axial thrust bearings.

According to an embodiment of the invention, the pressurized oil chamber includes an annular pressurized oil volume which surrounds the lower end portion of the drive shaft and which is externally delimited by the radial bearing housing.

According to an embodiment of the invention, the radial bearing housing includes a first housing part and a second housing part which are arranged at different positions in an axial direction, the first housing part including the inner radial bearing surface which has a first inner diameter, and the second housing part including an inner circumferential surface having a second inner diameter which is greater than the first inner diameter, the annular pressurized oil volume being externally delimited at least partially by the inner circumferential surface.

According to an embodiment of the invention, the annular pressurized oil volume is located below the inner radial bearing surface.

According to an embodiment of the invention, the lower end portion of the drive shaft includes a radial opening fluidly connected to an oil outlet of the oil pump, the radial opening facing the radial bearing housing and emerging in the pressurized oil chamber Thus, the radial opening provided on the drive shaft forms an inlet opening for the pressurized oil chamber. Advantageously, the oil outlet of the oil pump, which is fluidly connected to the radial opening, extends radially. Said oil outlet of the oil pump may be provided on a side wall part of the oil pump.

According to an embodiment of the invention, the radial opening emerges in the annular pressurized oil volume.

According to an embodiment of the invention, the upper axial thrust bearing is formed by an upper axial end surface of the radial bearing housing and by a shoulder surface secured to the drive shaft. The shoulder surface may be formed integral with the drive shaft or by a separate ring-shaped part secured to the drive shaft.

According to an embodiment of the invention, each of the upper axial end surface and the shoulder surface is annular.

According to an embodiment of the invention, the lower axial thrust bearing is formed by a lower axial end surface of the drive shaft and by an internal bottom surface of the radial bearing housing.

According to an embodiment of the invention, each of the lower axial end surface and the internal bottom surface is annular.

According to an embodiment of the invention, the internal bottom surface of the radial bearing housing is adjacent to the annular pressurized oil volume.

According to an embodiment of the invention, the radial bearing housing includes a radially inwardly projecting annular flange which includes the internal bottom surface. Advantageously, the radially inwardly projecting annular flange has an inner flange diameter which is smaller than the outer diameter of the lower end portion of the drive shaft.

According to an embodiment of the invention, the pressurized oil chamber further comprises an oil passage formed between the outer surface of lower end portion of the drive shaft and the inner surface of the radial bearing housing, the oil passage fluidly connecting the upper axial thrust bearing with an inlet opening of the pressurized oil chamber.

According to an embodiment of the invention, the oil passage extends along an extension direction which is substantially parallel to the longitudinal axis of the drive shaft.

According to an embodiment of the invention, the oil passage fluidly connects the upper axial thrust bearing with the annular pressurized oil volume.

According to an embodiment of the invention, the oil passage may be formed by at least one recess arranged in the outer surface of lower end portion of the drive shaft and/or in the inner surface of the radial bearing housing, and particularly in the inner radial bearing surface.

According to an embodiment of the invention, the oil passage is formed as a flat surface portion provided on the outer circumference of the lower end portion of the drive shaft.

According to an embodiment of the invention, thrust bearing surfaces of the upper and/or lower axial thrust bearings comprise lubrication grooves fluidly connected to the pressurized oil chamber. Such lubrication grooves allow to improve lubrication of the thrust bearing surfaces of the upper and/or lower axial thrust bearings.

According to an embodiment of the invention, each of the lubrication grooves extends from a radial inner side to a radial outer side of the respective thrust bearing surface, e.g. in a radial direction.

According to an embodiment of the invention, each of the lubrication grooves is circular and extends concentrically with the longitudinal axis of the drive shaft.

According to an embodiment of the invention, the oil pump is a centrifugal pump, such as a centrifugal pick-up pump. Such a centrifugal pick-up pump can be made with low cost.

According to another embodiment of the invention, the oil pump may be a positive-displacement pump, e.g. a gerotor oil pump.

According to an embodiment of the invention, the oil pump is attached, e.g. by press-fitting, in a recess formed at the lower axial end of the drive shaft.

According to an embodiment of the invention, the scroll compressor further includes a static tubular part secured to the radial bearing housing and surrounding the oil pump with a predetermined distance, such that an annular gap is formed between the static tubular part and the oil pump.

According to an embodiment of the invention, the annular gap formed between the static tubular part and the oil pump is between 0.5 and 1.5 mm, and for example around 1 mm.

According to an embodiment of the invention, the oil pump includes an oil inlet provided at the lower axial end of the oil pump, the static tubular part extending over the lower axial end of the oil pump. Due to said configuration, the static tubular part helps to minimize turbulences in the oil near the oil inlet of the oil pump.

According to an embodiment of the invention, the static tubular part axially protrudes from the lower axial end of the oil pump.

According to an embodiment of the invention, the scroll compressor is a variable speed compressor. At high rotational speed of the rotor and the drive shaft, high centrifugal speed of the oil occurs at the oil outlet of the oil pump, leading to a significant hydrodynamic pressure in the pressurized oil chamber. As the pressurized oil chamber is closed by the upper and lower axial thrust bearings, a hydrostatic force is created, which may be in the same magnitude as the gravitational force derived from the mass of the drive shaft. This improves the lubrication of the upper and lower axial thrust bearings and compressor efficiency due to reduced frictional losses. Further, wear of the thrust bearing surfaces is reduced, which improves the lifetime of the scroll compressor.

According to an embodiment of the invention, the lower bearing arrangement further comprises a bracket member secured to an inner surface of the hermetic outer shell, the radial bearing housing being secured to the bracket member.

According to an embodiment of the invention, the radial bearing housing includes a mounting part having a ring shape and being secured to the bracket member.

According to an embodiment of the invention, the radial bearing housing has a globally tubular shape.

BRIEF DESCRIPTION OF THE DRAWINGS

The following detailed description of one embodiment of the invention is better understood when read in conjunction with the appended drawings being understood, however, that the invention is not limited to the specific embodiment disclosed.

DETAILED DESCRIPTION

Figure 1:
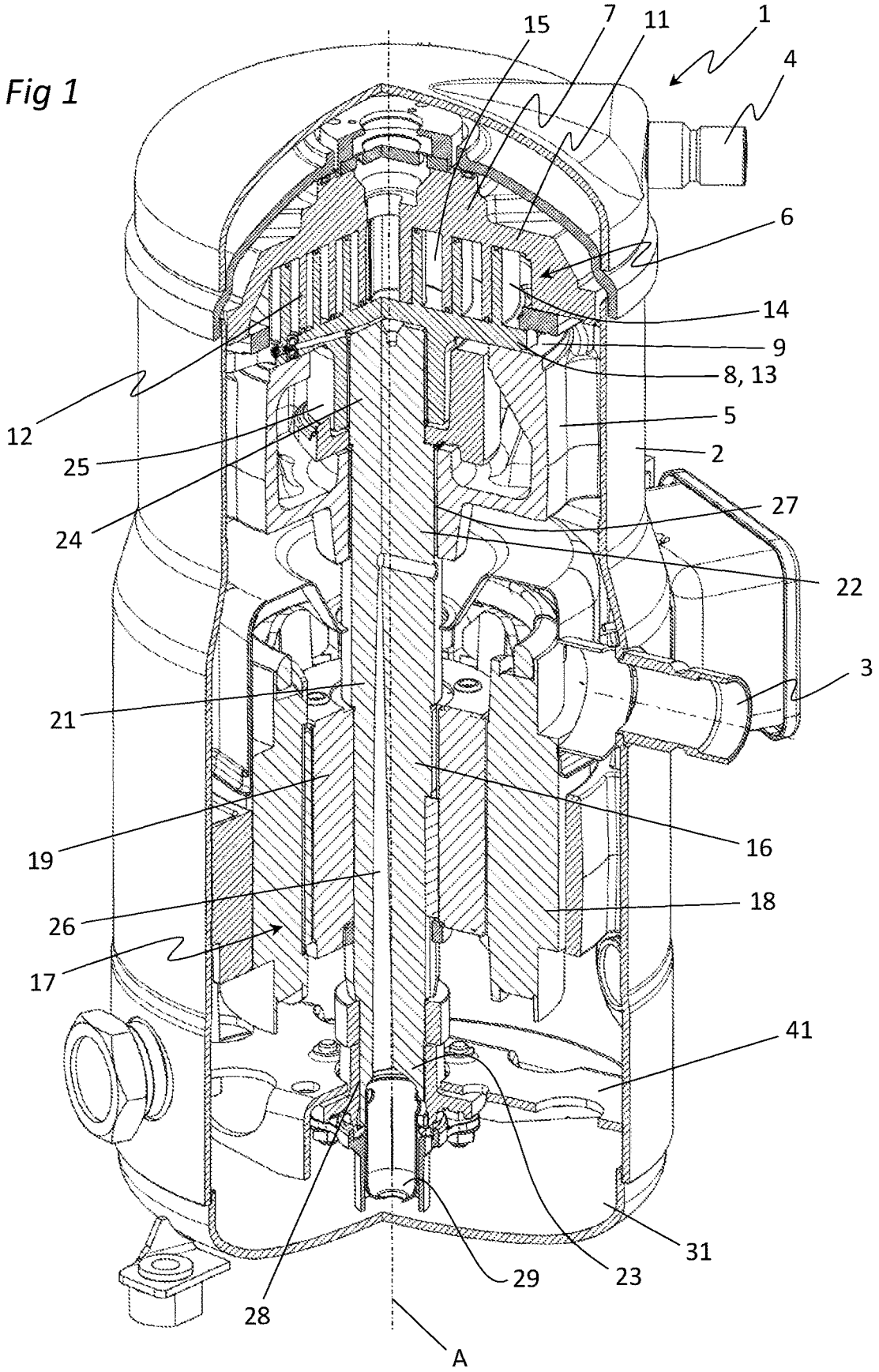
FIG. 1 is a perspective view, partially truncated, of a scroll compressor according to the invention.

FIG. 1 describes a scroll compressor 1 according to an embodiment of the invention.

The scroll compressor 1 includes a hermetic outer shell 2 provided with a suction inlet 3 configured to supply the scroll compressor 1 with refrigerant gas to be compressed, and with a discharge outlet 4 configured to discharge compressed refrigerant gas.

Particularly, the suction inlet 3 is intended to receive low pressure refrigerant gas from a component of a refrigerant cycle and the discharge outlet 4 is intended to deliver compressed refrigerant gas at high pressure to another component of the refrigerant cycle.

The scroll compressor 1 further includes a support arrangement 5 fixed to the hermetic outer shell 2, and a compression unit 6 disposed inside the hermetic outer shell 2 and supported by the support arrangement 5. The compression unit 6 is configured to compress the refrigerant gas supplied by the suction inlet 3.

According to the embodiment shown on the figures, the compression unit 6 includes a first scroll element 7, which is fixed in relation to the hermetic outer shell 2, and a second scroll element 8 which is supported by and in slidable contact with an upper thrust bearing surface 9 provided on the support arrangement 5. The second scroll element 8 is configured to perform an orbiting movement relative to the first scroll element 7 during operation of the scroll compressor 1.

The first scroll element 7 includes a fixed base plate 11 having a lower face oriented towards the second scroll element 8, and an upper face opposite to the lower face of the fixed base plate 11. The first scroll element 7 also includes a fixed spiral wrap 12 projecting from the lower face of the fixed base plate 11 towards the second scroll element 8.

The second scroll element 8 includes an orbiting base plate 13 having an upper face oriented towards the first scroll element 7, and a lower face opposite to the upper face of the orbiting base plate 13 and slidably mounted on the upper thrust bearing surface 9. The second scroll element 8 also includes an orbiting spiral wrap 14 projecting from the upper face of the orbiting base plate 13 towards the first scroll element 7. The orbiting spiral wrap 14 of the second scroll element 8 meshes with the fixed spiral wrap 12 of the first scroll element 7 to form a plurality of compression chambers 15 between them. Each of the compression chambers 15 has a variable volume which decreases from the outside towards the inside, when the second scroll element 8 is driven to orbit relative to the first scroll element 7.

Furthermore, the scroll compressor 1 includes a drive shaft 16 which is vertically orientated and which is configured to drive the second scroll element 8 in an orbital movement, and an electric motor 17, which may be for example a variable-speed electric motor, coupled to the drive shaft 16 and configured to drive in rotation the drive shaft 16 about a rotation axis A. The electric motor 17 comprises particularly a stator 18 connected to the hermetic outer shell 2 and a rotor 19 secured to the drive shaft 16.

The drive shaft 16 includes a longitudinal main part 21 including an upper end portion 22 and a lower end portion 23. The drive shaft 16 further includes a driving portion 24 which is provided at an upper end of the longitudinal main part 21 and which is offset from the longitudinal axis of the drive shaft 16. The driving portion 24 is partially mounted in a hub portion 25 provided on the second scroll element 8, and is configured to cooperate with the hub portion 25 so as to drive the second scroll element 8 in orbital movements relative to the first scroll element 7 when the electric motor 17 is operated.

The drive shaft 16 also includes an oil supplying channel 26 formed within the drive shaft 16 and extending over at least a part of the length of the drive shaft 16. According to the embodiment shown on the figures, the oil supplying channel 26 extends along the entire length of the drive shaft 16 and emerge in an upper axial end surface of the drive shaft 16.

The scroll compressor 1 further includes an upper bearing arrangement 27 and a lower bearing arrangement 28 which are connected to the hermetic outer shell 2 and which are configured to rotatably support respectively the upper end portion 22 of the longitudinal main part 21 and the lower end portion 23 of the longitudinal main part 21.

The scroll compressor 1 also includes an oil pump 29 arranged at a lower end of the drive shaft 16 and immersed in an oil sump 31 arranged in a bottom section of the hermetic outer shell 2. The oil pump 29 may be a centrifugal pump, such as a centrifugal pick-up pump, or a positive-displacement pump, such as a gerotor oil pump. According to the embodiment shown on the figures, the oil pump 29 is attached, e.g. by press-fitting, in a recess 32 formed at the lower axial end of the drive shaft 16, and includes an oil inlet 33 provided at the lower axial end of the oil pump 29.

The oil pump 29 is configured to deliver, during operation of the scroll compressor 1, oil, from the oil sump 31, to the compression unit 6 and to the upper and lower bearing arrangements 27, 28. The oil pump 29 is particularly configured to deliver, during operation of the scroll compressor 1, oil from the oil sump 31 to the compression unit 6 and to the upper bearing arrangement 27 through the oil supplying channel 26 formed within the drive shaft 16.

Figure 2:
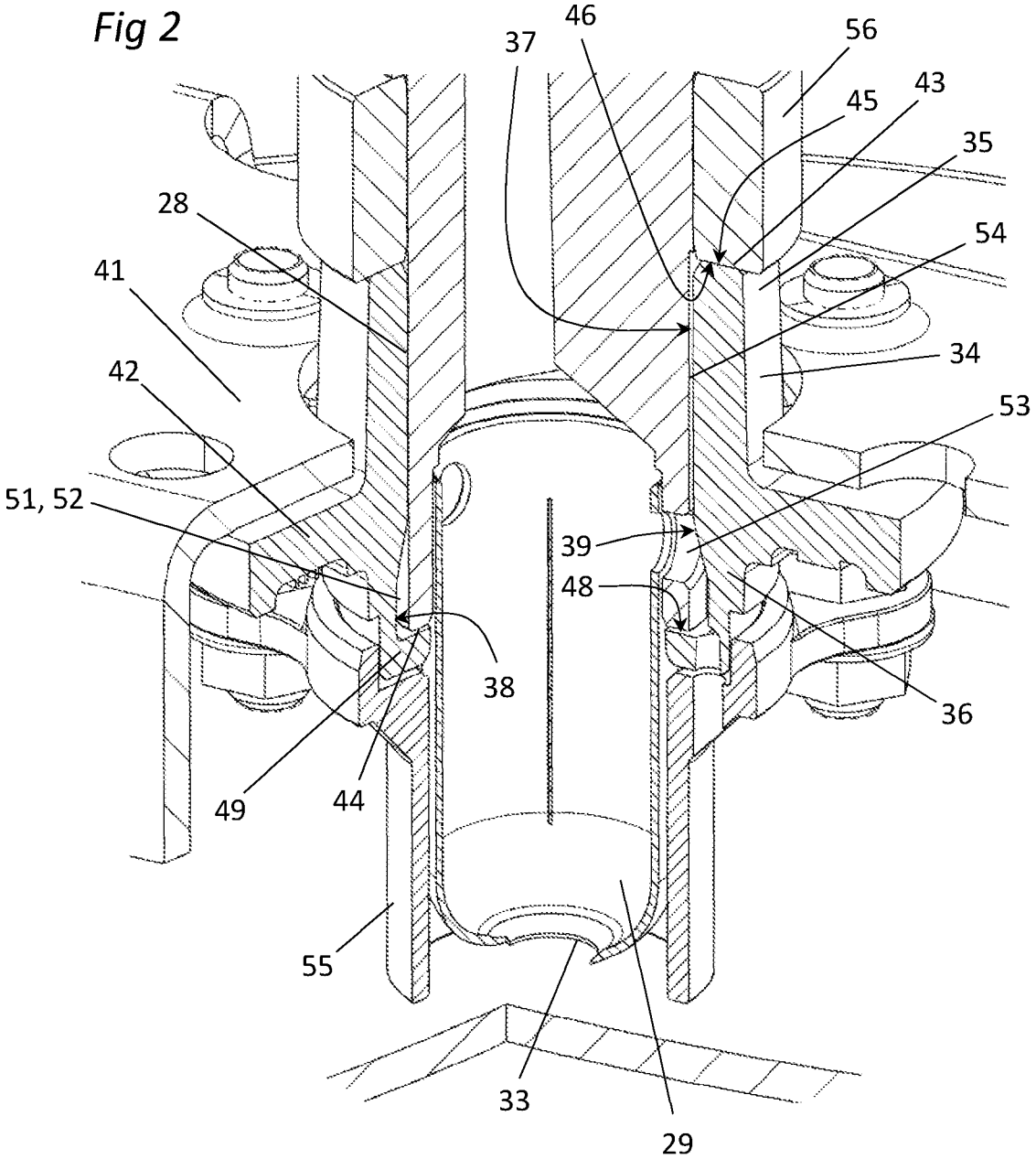
FIG. 2 is an enlarged view of a detail of FIG. 1.
Figure 3:
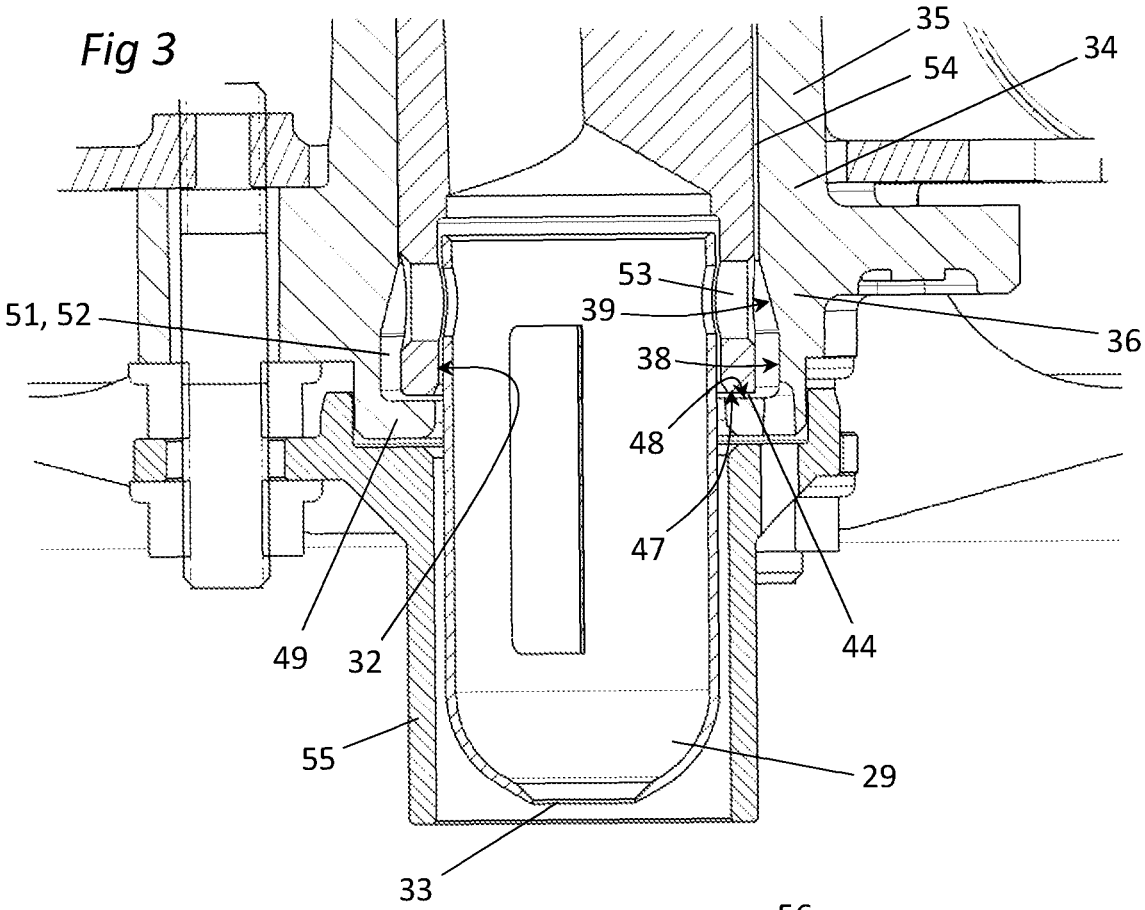
FIG. 3 is a partial longitudinal cross-section view of the scroll compressor of FIG. 1.
Figure 4:
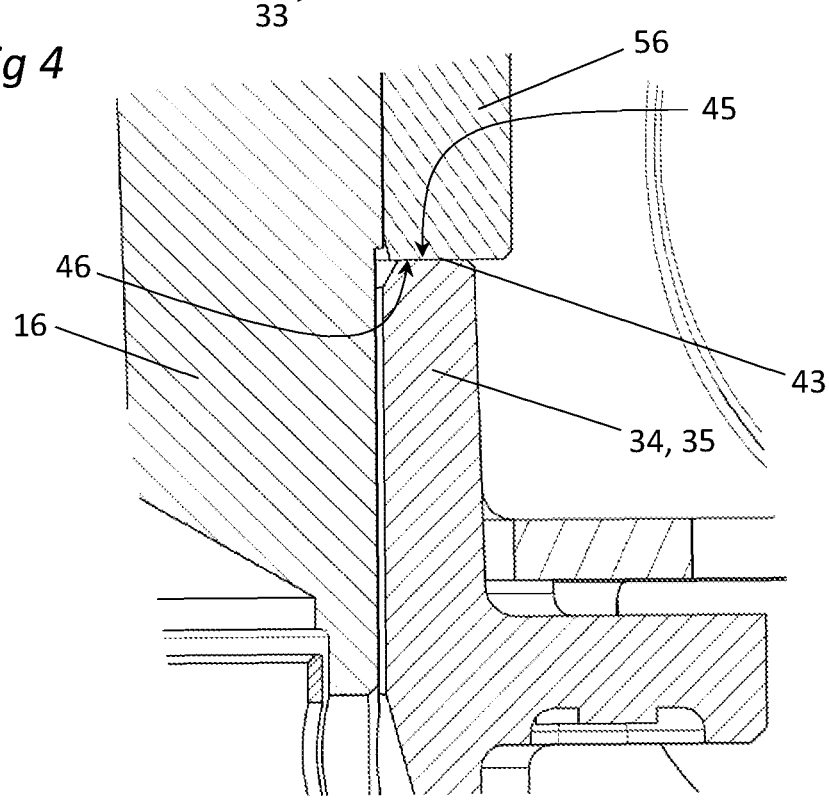
FIG. 4 is a partial longitudinal cross-section view of the scroll compressor of FIG. 1.

As better shown on FIGS. 2 and 3, the lower bearing arrangement 28 comprises a radial bearing housing 34 configured to rotatably support the lower end portion 23 of the drive shaft 16. The radial bearing housing 34 surrounds the lower end portion 23 of the drive shaft 16 and is arranged coaxially with the drive shaft 16. Advantageously, the radial bearing housing 34 has a globally tubular shape and is formed by a radial bearing sleeve.

According to the embodiment shown on the figures, the radial bearing housing 34 includes a first housing part 35 and a second housing part 36 which are arranged at different positions in an axial direction. Advantageously, each of the first and second housing parts 35, 36 has a circular ring section.

The first housing part 35 includes an inner radial bearing surface 37 which is cylindrical and which surrounds the outer surface of the lower end portion 23 of the drive shaft 16. The inner radial bearing surface 37 has a first inner diameter. The second housing part 36 includes an inner circumferential surface 38 having a second inner diameter which is greater than the first inner diameter. Advantageously, the second housing part 36 further includes an inner frustoconical surface 39 located between the inner radial bearing surface 37 and the inner circumferential surface 38 and diverging towards the inner circumferential surface 38.

The lower bearing arrangement 28 further comprises a bracket member 41 secured to an inner surface of the hermetic outer shell 2. Advantageously, the radial bearing housing 34 includes a mounting part 42 having a ring shape and being secured to the bracket member 41 for example by use of screws or bolts. The mounting part 42 is for example formed radially outward of the first and second housing parts 35, 36.

Furthermore, the lower bearing arrangement 28 comprises upper and lower axial thrust bearings 43, 44 configured to limit an axial movement of the drive shaft 16 during operation. Advantageously, the upper axial thrust bearing 43 is located above the inner radial bearing surface 37 and the lower axial thrust bearing 44 is located below the inner radial bearing surface 37.

According to the embodiment shown on the figures, the upper axial thrust bearing 43 is formed by an upper axial end surface 45 of the radial bearing housing 34 and by a shoulder surface 46 secured to the drive shaft 16. The shoulder surface 46 may be formed integral with the drive shaft 16 or may be formed by a separate ring-shaped part 56 secured to the drive shaft 16. Advantageously, the upper axial end surface 45 and the shoulder surface 46 are each annular.

According to the embodiment shown on the figures, the lower axial thrust bearing 44 is formed by a lower axial end surface 47 of the drive shaft 16 and by an internal bottom surface 48 of the radial bearing housing 34. Advantageously, the lower axial end surface 47 and the internal bottom surface 48 are each annular, and the radial bearing housing 34 includes a radially inwardly projecting annular flange 49 which includes the internal bottom surface 48. The radially inwardly projecting annular flange 49 has an inner flange diameter which is smaller than the outer diameter of the lower end portion 23 of the drive shaft 16.

The lower bearing arrangement 28 also comprises a pressurized oil chamber 51 which is fluidly connected to the oil pump 29. The pressurized oil chamber 51 is delimited by the outer surface of the lower end portion 23 of the drive shaft 16, the inner radial bearing surface 37, the inner circumferential surface 38 and the upper and lower axial thrust bearings 43, 44. Advantageously, the pressurized oil chamber 51 is delimited in an axial direction respectively by the upper and lower axial thrust bearings 43, 44.

As better shown on FIGS. 2 and 3, the pressurized oil chamber 51 includes an annular pressurized oil volume 52 which surrounds the lower end portion 23 of the drive shaft 16 and which is externally delimited by the radial bearing housing 34, and particularly by the inner circumferential surface 38 and the inner frustoconical surface 39.

Advantageously, the annular pressurized oil volume 52 is located below the inner radial bearing surface 37, and is adjacent to the internal bottom surface 48.

According to the embodiment shown on the figures, the lower end portion 23 of the drive shaft 16 includes a radial opening 53 fluidly connected to an oil outlet of the oil pump 29. Advantageously, the radial opening 53 faces the inner surface of the radial bearing housing 34 and emerges in the pressurized oil chamber 51 and particularly in the annular pressurized oil volume 52. Advantageously, the oil outlet of the oil pump 29, which is fluidly connected to the radial opening 53, extends radially and is provided on a side wall part of the oil pump 29.

The pressurized oil chamber 51 further comprises an oil passage 54 formed between the outer surface of lower end portion 23 of the drive shaft 16 and the inner surface of the radial bearing housing 34. Advantageously, the oil passage 54 extends along an extension direction which is substantially parallel to the longitudinal axis of the drive shaft 16. The oil passage 54 is particularly configured to fluidly connect the upper axial thrust bearing 43 with the annular pressurized oil volume 52 of the pressurized oil chamber 51.

Figure 5:
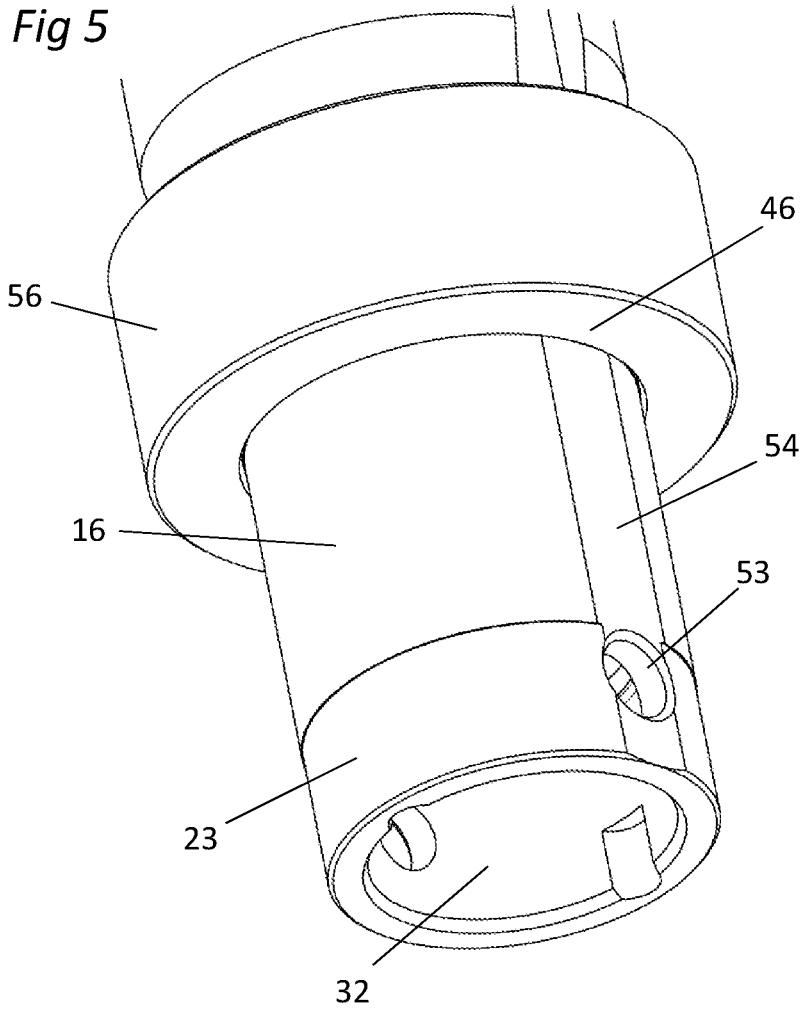
FIG. 5 is a partial perspective view of a drive shaft of the scroll compressor of FIG. 1.

The oil passage 54 may be formed by at least one recess arranged in the outer surface of lower end portion 23 of the drive shaft 16 and/or in the inner surface of the radial bearing housing 34, and particularly in the inner radial bearing surface 37. Preferably, the oil passage 54 is formed (see FIG. 5) as a flat surface portion provided on the outer circumference of the lower end portion 23 of the drive shaft 16.

According to an embodiment of the invention, the thrust bearing surfaces of the upper and/or lower axial thrust bearings 43, 44, which are formed by the upper axial end surface 45, the shoulder surface 46, the lower axial end surface 47 and the internal bottom surface 48, may comprise lubrication grooves fluidly connected to the pressurized oil chamber 51 so as to improve lubrication of the thrust bearing surfaces of the upper and/or lower axial thrust bearings 43, 44. Each of the lubrication grooves may extend from a radial inner side to a radial outer side of the respective thrust bearing surface, e.g. in a radial direction. Alternatively, each of the lubrication grooves may be circular and extend concentrically with the longitudinal axis of the drive shaft 16.

As previously mentioned the scroll compressor 1 is advantageously a variable speed compressor. At high rotational speed of the rotor 19 and the drive shaft 16, the oil delivered by the oil outlet of the oil pump is high and thus high oil centrifugal speed occurs at the radial opening 53 of the drive shaft 16, leading to a significant hydrodynamic pressure in the pressurized oil chamber 51. As the pressurized oil chamber 51 is closed by the upper and lower axial thrust bearings 43, 44, a hydrostatic force is created, which may be in the same magnitude as the gravitational force derived from the mass of the drive shaft 16. This improves the lubrication of the upper and lower axial thrust bearings 43, 44 and compressor efficiency due to reduced frictional losses. Further, wear of the thrust bearing surfaces of the upper and lower axial thrust bearings 43, 44, and particularly of the lower axial thrust bearing 44, is reduced, which improves the lifetime of the scroll compressor 1.

As better shown on FIG. 2, the scroll compressor 1 further includes a static tubular part 55 secured to the radial bearing housing 34 and surrounding the oil pump 29 with a predetermined distance, such that an annular gap is formed between the static tubular part 55 and the oil pump 29. The annular gap may be between 0.5 and 5 mm, and for example around 2 mm. The static tubular part 55 extends over the lower axial end of the oil pump 29 and advantageously axially protrudes from the lower axial end of the oil pump 29.

Due to said configuration, the static tubular part 55 helps to minimize turbulences in the oil located near the oil inlet 33 of the oil pump 29, and thus to further improve the compressor efficiency.

Of course, the invention is not restricted to the embodiment described above by way of non-limiting example, but on the contrary it encompasses all embodiments thereof.

What is claimed is:

1. A scroll compressor including:

a hermetic outer shell provided with a suction inlet configured to supply the scroll compressor with refrigerant gas to be compressed and a discharge outlet configured to discharge compressed refrigerant gas, a compression unit including at least a first scroll element and a second scroll element, the second scroll element being configured to perform an orbiting movement relative to the first scroll element during operation of the scroll compressor, a drive shaft which is vertically orientated and which is configured to cooperate with the second scroll element, an electric motor comprising a stator connected to the hermetic outer shell and a rotor secured to the drive shaft, the electric motor being configured to drive in rotation the drive shaft about a rotation axis, an upper bearing arrangement and a lower bearing arrangement configured to rotatably support the drive shaft within the hermetic outer shell, an oil pump arranged at a lower end of the drive shaft and immersed in an oil sump arranged in a bottom section of the hermetic outer shell, the oil pump being configured to deliver, during operation of the scroll compressor, oil to the compression unit and to the upper and lower bearing arrangements, wherein the lower bearing arrangement comprises:

a radial bearing housing configured to rotatably support a lower end portion of the drive shaft, the radial bearing housing including an inner radial bearing surface surrounding an outer surface of the lower end portion of the drive shaft, upper and lower axial thrust bearings configured to limit an axial movement of the drive shaft during operation, and a pressurized oil chamber which is fluidly connected to the oil pump, the pressurized oil chamber being at least partially delimited by the outer surface of the lower end portion of the drive shaft, the inner radial bearing surface and the upper and lower axial thrust bearings, wherein the lower end portion of the drive shaft includes a radial opening fluidly connected to an oil outlet of the oil pump, the radial opening facing the radial bearing housing and emerging in the pressurized oil chamber.

2. The scroll compressor according to claim 1, wherein the upper axial thrust bearing is located above the inner radial bearing surface and the lower axial thrust bearing is located below the inner radial bearing surface.

3. The scroll compressor according to claim 2, wherein the pressurized oil chamber is delimited in an axial direction respectively by the upper and lower axial thrust bearings.

4. The scroll compressor according to claim 2, wherein the pressurized oil chamber includes an annular pressurized oil volume which surrounds the lower end portion of the drive shaft and which is externally delimited by the radial bearing housing.

5. The scroll compressor according to claim 1, wherein the pressurized oil chamber is delimited in an axial direction respectively by the upper and lower axial thrust bearings.

6. The scroll compressor according to claim 5, wherein the pressurized oil chamber includes an annular pressurized oil volume which surrounds the lower end portion of the drive shaft and which is externally delimited by the radial bearing housing.

7. The scroll compressor according to claim 1, wherein the pressurized oil chamber includes an annular pressurized oil volume which surrounds the lower end portion of the drive shaft and which is externally delimited by the radial bearing housing.

8. The scroll compressor according to claim 7, wherein the radial bearing housing includes a first housing part and a second housing part which are arranged at different positions in an axial direction, the first housing part including the inner radial bearing surface which has a first inner diameter, and the second housing part including an inner circumferential surface having a second inner diameter which is greater than the first inner diameter, the annular pressurized oil volume being externally delimited at least partially by the inner circumferential surface.

9. The scroll compressor according to claim 1, wherein the upper axial thrust bearing is formed by an upper axial end surface of the radial bearing housing and by a shoulder surface secured to the drive shaft.

10. The scroll compressor according to claim 1, wherein the lower axial thrust bearing is formed by a lower axial end surface of the drive shaft and by an internal bottom surface of the radial bearing housing.

11. The scroll compressor according to claim 1, wherein the pressurized oil chamber further comprises an oil passage formed between the outer surface of lower end portion of the drive shaft and the inner surface of the radial bearing housing, the oil passage fluidly connecting the upper axial thrust bearing with an inlet opening of the pressurized oil chamber.

12. The scroll compressor according to claim 11, wherein the oil passage is formed as a flat surface portion provided on the outer circumference of the lower end portion of the drive shaft.

13. The scroll compressor according to claim 1, wherein thrust bearing surfaces of the upper and/or lower axial thrust bearings comprise lubrication grooves fluidly connected to the pressurized oil chamber.

14. The scroll compressor according to claim 1, wherein the scroll compressor further includes a static tubular part secured to the radial bearing housing and surrounding the oil pump with a predetermined distance, such that an annular gap is formed between the static tubular part and the oil pump.

15. The scroll compressor according to claim 14, wherein the oil pump includes an oil inlet provided at the lower axial end of the oil pump, the static tubular part extending over the lower axial end of the oil pump.

16. The scroll compressor according to claim 1, wherein the scroll compressor is a variable speed compressor.

17. A scroll compressor including:

a hermetic outer shell provided with a suction inlet configured to supply the scroll compressor with refrigerant gas to be compressed and a discharge outlet configured to discharge compressed refrigerant gas, a compression unit including at least a first scroll element and a second scroll element, the second scroll element being configured to perform an orbiting movement relative to the first scroll element during operation of the scroll compressor, a drive shaft which is vertically orientated and which is configured to cooperate with the second scroll element, an electric motor comprising a stator connected to the hermetic outer shell and a rotor secured to the drive shaft, the electric motor being configured to drive in rotation the drive shaft about a rotation axis, an upper bearing arrangement and a lower bearing arrangement configured to rotatably support the drive shaft within the hermetic outer shell, an oil pump arranged at a lower end of the drive shaft and immersed in an oil sump arranged in a bottom section of the hermetic outer shell, the oil pump being configured to deliver, during operation of the scroll compressor, oil to the compression unit and to the upper and lower bearing arrangements, wherein the lower bearing arrangement comprises:

a radial bearing housing configured to rotatably support a lower end portion of the drive shaft, the radial bearing housing including an inner radial bearing surface surrounding an outer surface of the lower end portion of the drive shaft, upper and lower axial thrust bearings configured to limit an axial movement of the drive shaft during operation, and a pressurized oil chamber which is fluidly connected to the oil pump, the pressurized oil chamber being at least partially delimited by the outer surface of the lower end portion of the drive shaft, the inner radial bearing surface and the upper and lower axial thrust bearings, wherein the pressurized oil chamber includes an annular pressurized oil volume which surrounds the lower end portion of the drive shaft, wherein the drive shaft and the lower bearing arrangement are configured such that, during operation, oil flows into the annular pressurized oil volume from the oil pump through a radial opening in the drive shaft, and wherein the radial opening in the drive shaft and the annular pressurized oil volume are lower than the inner radial bearing surface.

18. A scroll compressor including:

a hermetic outer shell provided with a suction inlet configured to supply the scroll compressor with refrigerant gas to be compressed and a discharge outlet configured to discharge compressed refrigerant gas, a compression unit including at least a first scroll element and a second scroll element, the second scroll element being configured to perform an orbiting movement relative to the first scroll element during operation of the scroll compressor, a drive shaft which is vertically orientated and which is configured to cooperate with the second scroll element, an electric motor comprising a stator connected to the hermetic outer shell and a rotor secured to the drive shaft, the electric motor being configured to drive in rotation the drive shaft about a rotation axis, an upper bearing arrangement and a lower bearing arrangement configured to rotatably support the drive shaft within the hermetic outer shell, an oil pump arranged at a lower end of the drive shaft and immersed in an oil sump arranged in a bottom section of the hermetic outer shell, the oil pump being configured to deliver, during operation of the scroll compressor, oil to the compression unit and to the upper and lower bearing arrangements, wherein the lower bearing arrangement comprises:

a radial bearing housing configured to rotatably support a lower end portion of the drive shaft, the radial bearing housing including an inner radial bearing surface surrounding an outer surface of the lower end portion of the drive shaft, upper and lower axial thrust bearings configured to limit an axial movement of the drive shaft during operation, and a pressurized oil chamber which is fluidly connected to the oil pump, the pressurized oil chamber being at least partially delimited by the outer surface of the lower end portion of the drive shaft, the inner radial bearing surface and the upper and lower axial thrust bearings, wherein the pressurized oil chamber includes an annular pressurized oil volume which surrounds the lower end portion of the drive shaft, wherein the drive shaft and the lower bearing arrangement are configured such that, during operation, oil flows into the annular pressurized oil volume from the oil pump through a radial opening in the drive shaft, and wherein the radial opening in the drive shaft is arranged between the oil pump and the inner radial bearing surface.

* * * * *